US005291768A

United States Patent [19]

Rieffel et al.

[11] Patent Number: 5,291,768

[45] Date of Patent: Mar. 8, 1994

[54] PLASTIC KEY TAG WITH A KEY BAR

[75] Inventors: Robert Rieffel, Wallisellen; Ernst Vögeli, Zurich, both of Switzerland

[73] Assignee: Robert Rieffel AG, Switzerland

[21] Appl. No.: 867,830

[22] Filed: Apr. 10, 1992

[30] Foreign Application Priority Data

Apr. 12, 1991 [CH] Switzerland ..... 01091/91

[51] Int. Cl.[5] ..... E05B 19/24

[52] U.S. Cl. ..... 70/460; 40/634; 73/456 R; 73/457; 73/458

[58] Field of Search ..... 70/456 R, 456 B, 457–460; 206/37.1, 37.6, 37.7, 37.8, 38.1; 24/3 K; 40/330, 634, 663; 16/225

[56] References Cited

U.S. PATENT DOCUMENTS

| | | | |
|---|---|---|---|
| 1,198,826 | 9/1916 | Dansereau | 40/663 |
| 1,474,315 | 11/1923 | Carmel | 206/37.6 |
| 1,984,069 | 12/1934 | Larter | 70/456 R |
| 2,157,788 | 5/1939 | Howell | 248/301 |
| 3,111,152 | 11/1963 | Goessling | 206/37.8 |
| 3,209,479 | 10/1965 | Manzardo | 206/37.1 |
| 3,620,057 | 11/1971 | Holland | 70/456 R |
| 3,793,612 | 2/1974 | Driscoll | 16/225 |
| 3,908,418 | 9/1975 | Stoffel | 70/456 R |
| 4,072,033 | 2/1978 | Eckerdt . | |
| 4,137,740 | 2/1979 | Eckerdt . | |
| 4,358,944 | 11/1982 | Stoffel | 70/457 |
| 4,799,587 | 1/1989 | Desanto | 206/37.6 |
| 5,038,590 | 8/1991 | Sawyer et al. | 70/457 |
| 5,083,662 | 1/1992 | Bishop et al. | 206/37.1 |
| 5,113,602 | 5/1992 | Levine et al. | 40/330 |
| 5,121,834 | 6/1992 | Tissembaum | 206/37.1 |

FOREIGN PATENT DOCUMENTS

| | | | |
|---|---|---|---|
| 0149102 | 7/1985 | European Pat. Off. . | |
| 3578 | of 1898 | United Kingdom | 40/363 |
| 2225605 | 6/1990 | United Kingdom | 740/456 R |

*Primary Examiner*—Peter M. Cuomo
*Assistant Examiner*—Darnell M. Boucher
*Attorney, Agent, or Firm*—Speckman, Pauley & Fejer

[57] ABSTRACT

A marker plate receptacle, formed by two plates pivotably connected with each other via a film hinge, in which a marker plate is received. A tongue is formed in one piece on the lower end of one of the two plates. It has a hook which can be put over a wall extending perpendicularly to the surface of the inside of the plate and around a through hole. Once the marker plate is inserted and the hook of the tongue, on which a key is placed, is put over the annular wall, the two plates are folded together. The tongue is then form-fittingly maintained between the two plates and the plates themselves are maintained by a form-fitting ridge formed on the annular wall, which extends through the through hole in the rear plate. The form fit is additionally improved with ribs engaging grooves.

16 Claims, 2 Drawing Sheets

PLASTIC KEY TAG WITH A KEY BAR

BACKGROUND OF THE INVENTION

1. Field of the Invention

This invention relates to a plastic key tag having a marker plate receptacle with a through hole used for hanging it and with an open tongue for fastening a key on the receptacle. This invention also relates to a plastic key bar with a plurality of hooks for receiving the key tag of this invention.

2. Description of Prior Art

Conventional key tags are known, where the marker plate receptacle consists of two plates welded together, the plate oriented towards the visible side having a window. A through hole used for hanging the key tag is provided in the hanging position of use. A second through hole is positioned below the window, which also extends through both plates and through which is positioned an S-shaped metal tongue, in the manner of a hook. A slit positioned at the lower end is used for inserting the marker plate. However, in order to be able to insert the marker plate, it is first necessary to remove the metal tongue in a cumbersome way and to thread it afterwards in the same cumbersome way. Placing the key on the metal tongue is also not user-friendly. In this case, it is necessary to bend open the S-shaped metal tongue in order to insert the key. Also, in their position of use, such key tags require a great amount of space in the vertical direction. Accordingly, in a key box in which a plurality of keyboards are positioned vertically one above the other, it is necessary to attach the key bars at great distances from each other.

Key tags have also been developed which are designed only for key bars which are particularly adapted to them. For example, U.S. Pat. Nos. 4,072,033 and 4,137,740 disclose key tags which do not have through holes for hanging them from hooks. In this case, one side of the marker plate receptacles is equipped with a Velcro band, which is directly connected with a key bar also having a Velcro band. In this case, the key-receiving tongues are designed as metal rings. Another different solution is disclosed in European Patent EP-PS-0,149,102, where a very complicated and expensive key bar is used, into which a key tag can be inserted from below. Such key tag has a marker plate receptacle with a pushbutton-like spring, which can be locked in an opening in the key bar. Such key tag has an annular element on its lower end on which a key can be fastened with a key ring. The embodiment of the tongue and how it is connected with the key tag cannot be determined from such document.

SUMMARY OF THE INVENTION

It is the one object of this invention to provide a key tag of the previously mentioned type which is particularly user-friendly, can be produced at a reasonable cost and used in a space-saving way together with an appropriately adapted key bar.

It is a further object of this invention to provide a key bar which is adapted to the key tag of this invention.

The first object is accomplished with a key tag having a marker plate receptacle with a through hole for hanging it, wherein the key can be fastened on the receptacle. The marker plate receptacle has two plates connected in one piece with a film hinge and together, the plates form a foldable, form-fittingly lockable frame for receiving the marker plate.

The second object is accomplished with a plastic key bar having a plurality of hooks for receiving the key tag of this invention, and having a groove over its entire length for inserting a marker strip, the width of which corresponds approximately to the height of the marker plates fitting into the marker plate receptacle. The distance between the groove and the hooks corresponds to the distance between the window and the hole of the key tag. Further advantageous embodiments of the key tag and of the key bar are discussed and claimed below.

BRIEF DESCRIPTION OF THE DRAWINGS

A preferred embodiment is shown in detail in the drawings and will be explained in the following description wherein.

DESCRIPTION OF PREFERRED EMBODIMENTS

Figure 1:
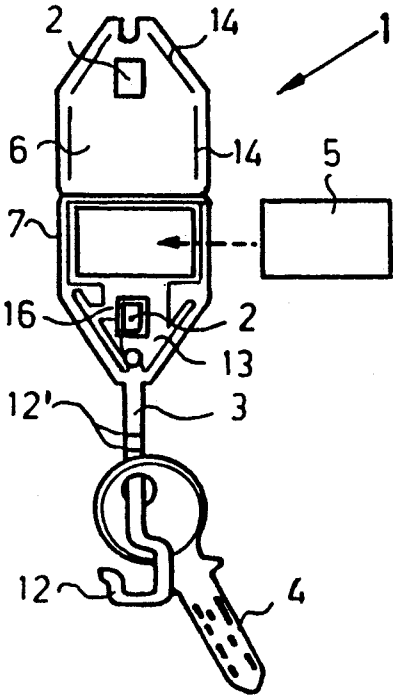
FIG. 1 shows a key tag in the completely open position after manufacturing.

The key tag in accordance with this invention has a marker plate receptacle 1 comprising two plates 6 and 7 connected with each other via a film hinge 9. The two plates 6 and 7 are embodied in such a way that they form a rectangular portion 10 and a triangular portion 11, positioned on one longitudinal edge. The film hinge 9 connecting the two plates 6 and 7 extends along the second, common longitudinal edge of the respective rectangular portion 10. The inner surfaces of the two plates 6 and 7 are visible in FIGS. 1 and 2. The plate 6, shown on top in FIGS. 1 and 2, has the through hole 2 as its only perforation, which is used for hanging the key tag on a keyboard or a key bar. But the plate 7, shown relatively lower in FIGS. 1 and 2, has three openings. These are the window 8, visible on the top in FIG. 2, which allows a view of the marker plate 5 which is insertable and which is exchangeable. This window 8 is almost approximately of the same size as the rectangular portion 10 of the plate 7. Centered under the window 8 and in the triangular portion 11 of the plate 7, there is another through hole 2 which, as already described, is used for hanging the key tag on a key bar or a keyboard. A round through hole 3' is located exactly perpendicularly underneath the through hole 2 in the vicinity of the tip of the triangular portion 11. An open tongue 3 has been extruded in the extension of the tip of the triangular portion 11 of the lower plate 7, which has a hook 12 at its lower end. Perpendicularly to its extension, the tongue 3 has two film hinges 12' located relatively close to each other.

Figure 2:
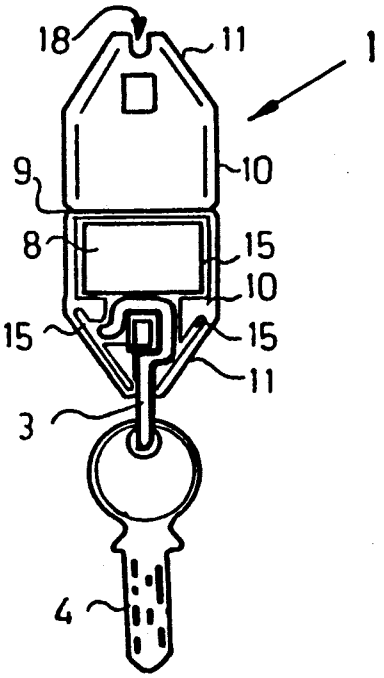
FIG. 2 shows a key tag still in the open position with the key already fixed on it.
Figure 3:
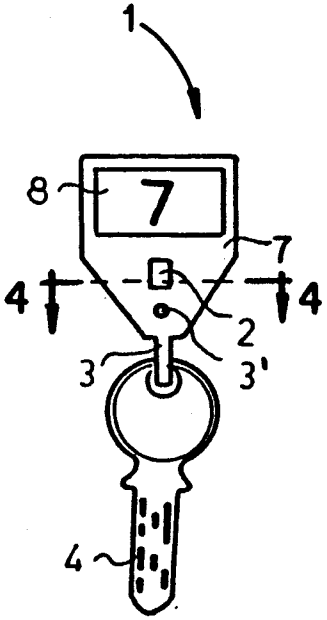
FIG. 3 shows a key tag in the completed, assembled position ready for use.
Figure 4:
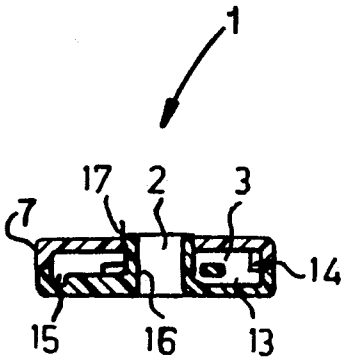
FIG. 4 shows a section along the line A-A through the key tag as shown in FIG. 3.

To use the key tag in accordance with this invention, first the marker plate 5, provided with an identification, is placed through the window 8 in the plate 7 into the folded-open marker plate receptacle 1. Then the key 4 to be hung up is threaded on the open tongue 3. The lower end of the tongue 3 with its hook 12 is then rotated upwards by 180°. Next, the key 4 comes to rest exactly between the two film hinges 12' of the tongue 3. The through hole 2 in the lower plate 7 is provided with an annular wall 16, upwardly extending perpendicular to the plane of the plate, which is provided on its top with a form closure ridge 17, as shown in FIG. 4. The hook 12 of the tongue 3 fits in an exactly form-fitting manner around this vertical annular wall 16. The form closure ridge 17 causes the hook 12 of the tongue 3 to remain in its position, when the lower part is pivoted by 180°, as shown in FIG. 2. Now the upper plate 6 is pivoted by 180° around the film hinge 9 onto the lower plate 7, so that the inner surfaces of both plates 6 and 7 come to rest on each other. During this, the vertical annular wall 16 extends through the through hole 2 in the upper plate 6. Now, the form closure ridge 17 on the wall 16 provides a form-fitting connection, already sufficient in itself, between the two plates 6 and 7 of the marker plate receptacle 1 forming a hinged frame. However, additional form closure means are provided in the example now described. These are formed by ribs 14 with corresponding ridges, not shown, and grooves 15 in the lower plate 7. These grooves 15 are formed in that the thickness of the wall of the lower plate 7 is partially increased. The plate thickness is reduced at the grooves 15, as well as in the area where the folded lower part of the tongue with the hook 12 comes to rest. In this way, an almost annular form-fitting connection between the two plates 6 and 7 hinged on each other is the result.

If it is desired to use the key tag together with a key ring with a plurality of keys, it is possible to simply cut off the tongue 3 so that in the closed state of the marker plate receptacle 1 it no longer comes to rest in front of the hole 3', so that it can be used to receive a key ring. In the closed state of the receptacle 1, the hole 3' is aligned with a U-shaped cutout 18 at the tip of the rear plate 6. But the cutout 18 also has a purpose if the key tag with the appropriate tongue 3 is used. If the attached key 4 is rotated in relation to the receptacle 1, the tongue 3 is rotated. Accordingly, there would be the danger that the closed plates 6 and 7, which are form-fittingly connected with each other, would be forced apart by the width of the tongue 3. This is prevented with the U-shaped cutout 18.

Besides the embodiment shown in the drawings wherein the open tongue 3 is maintained between the two plates 6 and 7, which are pivotable towards each other, it would also be possible to shape the tongue 3 simply as a straight band having at its lower end teeth which would be received in corresponding teeth located in at least one of the folding plates 6, 7. This embodiment is not shown in the drawings.

Figure 6:
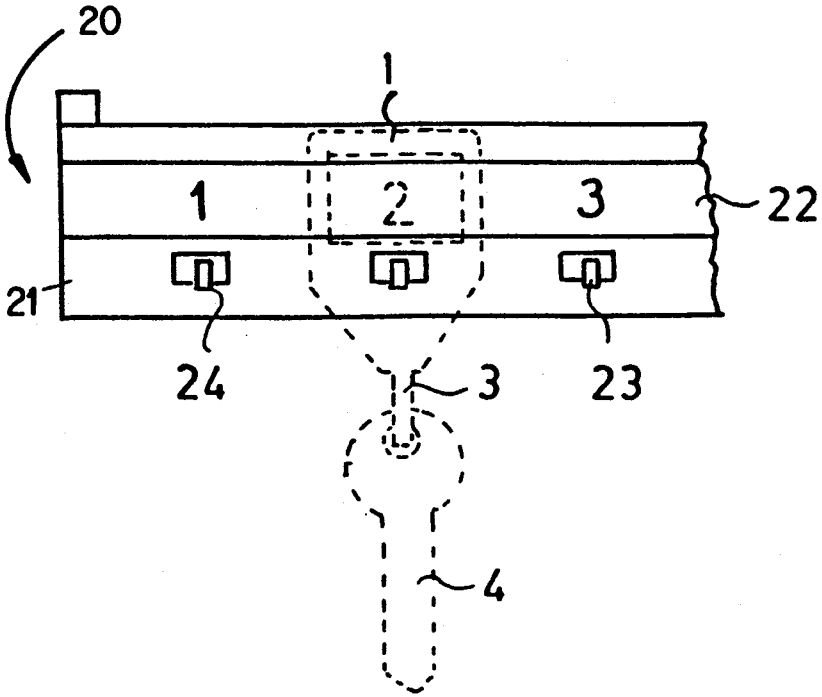
FIG. 6 shows a front view of the key bar shown in FIG. 5.
Figure 5:
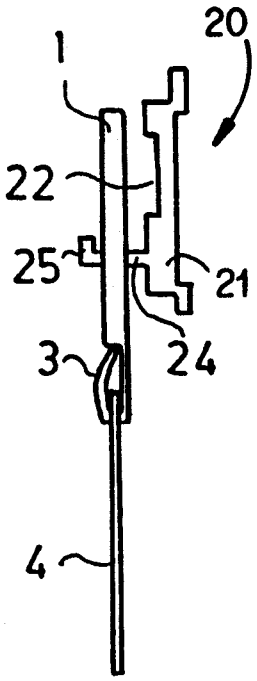
FIG. 5 shows a side view of a key bar, also in accordance with this invention, which is adapted to the key tag of this invention.

Integration of the tongue 3 by means of which the key 4 can be directly attached to the marker plate receptacle 1 and the disposition of the through hole 2 for hanging the key tag below the window 7 results in a particularly space-saving combination of the key tag with a correspondingly designed key bar 20, shown in FIGS. 5 and 6. The key bar 20 comprises a rail 21 with a groove 22 cut over its entire length, which is used to receive a marker strip. Hooks 23, connected in one piece with the bar, are formed below the groove 22. They have a perpendicularly extending strut 24, the length of which is slightly greater than the thickness of the marker plate receptacle 1. The vertically upwards extending tip 25 at the end of the strut 24 almost exactly corresponds in its size to the through hole for hanging up the key tag. The key tag and the key bar 20 are designed in such a way that, when the key tag is hung up, its marker plate 5 comes to rest exactly over the marker strip in the groove 22. A simple and conspicuous check for the presence of all stored keys is possible with this embodiment.

We claim:

1. In a plastic key tag having a marker plate receptacle (1) with a through hole (2) and means for fastening a key (4) on the marker plate receptacle (1), the marker plate receptacle (1) having two plates (6,7) connected in one piece via a film hinge (9) which together form a foldable, form-fitting lockable frame that receives a marker plate (5), the improvement comprising:

the means for fastening the key (4) comprising a one-piece tongue (3) shaped as a band and having a fixed end connected with one plate (7) of the two foldable plates (6,7);

a free end (12) of the tongue (3) being form-fitting received between the two plates (6,7) when connected with each other; and the band having two film hinges (12') extending crosswise to a longitudinal direction of the band and forming a lower end of the tongue (3) when the free end (12) is form-fitted between the two plates (6,7) connected with each other.

2. A key tag in accordance with claim 1, wherein the marker plate receptacle (1) has a rectangular portion (10) with a triangular portion (11) merged into a bottom of the rectangular portion (10) in a hanging position, the marker plate (5) housed therein is received in the rectangular portion (10), the through hole (2) is centered in the triangular portion (11), and the tongue (3) is connected on a tip of the triangular portion (11).

3. A key tag in accordance with claim 1, wherein the tongue (3) has teeth on edges of a lower end of the band, which are received in corresponding teeth on at least one inner surface of the two foldable plates (6,7).

4. A key tag in accordance with claim 1, wherein the two plates (6,7) further comprise a form-fitting closure (14,15) on their surfaces which come to rest on each other.

5. A key tag in accordance with claim 1, wherein one plate (7) of the two foldable plates (6,7) has a wall (16) on an inner surface around the through hole (2) extending perpendicularly to the surface which in a folded state of the marker plate receptacle (1) extends through the through hole (2) of the other plate (6) of the two foldable plates (6,7) and fixes a position of the two foldable plates (6,7) with respect to each other by a form-fitting ridge (17).

6. A key tag in accordance with claim 5, wherein the free end (12) of the tongue (3) has a shape corresponding to the wall (16) encircling the through hole (2) and the free end (12) is positionable over the wall (16) prior to folding the two foldable plates (6,7) together.

7. A key tag in accordance with claim 2, wherein the tongue (3) is formed at the tip of one plate (7) of the two plates (6,7), and a tip of the other plate (6) of the two plates (6,7) has a U-shaped cutout (18) which corresponds in width to a width of the tongue (3).

8. In a plastic key tag having a marker plate receptacle (1) with a through hole (2) and means for fastening a key (4) on the marker plate receptacle (1), the marker plate receptacle (1) having two plates (6,7) connected in one piece via a film hinge (9) which together form a foldable, form-fitting lockable frame that receives a marker plate (5), the improvement comprising:

the means for fastening the key (4) comprising a one-piece tongue (3) shaped as a band and having a fixed end connected with one plate (7) of the two foldable plates (6,7), a free end of the tongue (3) being form-fittingly received between the two plates (6,7) when connected with each other, the band having two film hinges (12') extending crosswise to a longitudinal direction of the band and forming a lower end of the tongue (3) when the free end (12) is form-fitting between the two plates (6,7) when connected with each other;

said free end (12) of the tongue (3) having a shape corresponding to a wall (16) on an inner surface of one plate (7) of the plates (6,7), the wall (16) encircling the through hole (2) and the free end (12) being positionable over the wall (16) when the two plates (6,7) are in an open condition with respect to each other.

9. A key tag in accordance with claim 1, wherein the tongue (3) is formed at the tip of one plate (7) of the two plates (6,7), and a tip of the other plate (6) of the two plates (6,7) has a U-shaped cutout (18) which corresponds in width to a width of the tongue (3).

10. A key tag in accordance with claim 8, wherein the marker plate receptacle (1) has a rectangular portion (10) with a triangular portion (11) merged into a bottom of the rectangular portion (10) in a hanging position, the marker plate (5) housed therein is received in the rectangular portion (10), the through hole (2) is centered in the triangular portion (11), and the tongue (3) is connected on a tip of the triangular portion (11).

11. A key tag in accordance with claim 8, wherein the tongue (3) has teeth on edges of a lower end of the band, which are received in corresponding teeth on at least one inner surface of the two foldable plates (6,7).

12. A key tag in accordance with claim 8, wherein the two plates (6,7) further comprise a form-fitting closure (14,15) on their surfaces which come to rest on each other.

13. A key tag in accordance with claim 8, wherein one plate (7) of the two foldable plates (6,7) has a wall (16) on an inner surface around the through hole (2) extending perpendicularly to the surface which in a folded state of the marker plate receptacle (1) extends through the through hole (2) of the other plate (6) of the two foldable plates (6,7) and fixes a position of the two foldable plates (6,7) with respect to each other by a form-fitting ridge (17).

14. A key tag in accordance with claim 13, wherein the free end (12) of the tongue (3) has a shape corresponding to the wall (16) encircling the through hole (2) and the free end (12) is positionable over the wall (16) prior to folding the two foldable plates (6,7) together.

15. A key tag in accordance with claim 10, wherein the tongue (3) is formed at the tip of one plate (7) of the two plates (6,7), and a tip of the other plate (6) of the two plates (6,7) has a U-shaped cutout (18) which corresponds in width to a width of the tongue (3).

16. A key tag in accordance with claim 8, wherein the tongue (3) is formed at the tip of one plate (7) of the two plates (6,7), and a tip of the other plate (6) of the two plates (6,7) has a U-shaped cutout (18) which corresponds in width to a width of the tongue (3).

* * * * *